US009999261B2

(12) United States Patent
Hoeven

(10) Patent No.: US 9,999,261 B2
(45) Date of Patent: Jun. 19, 2018

(54) BRA WITH A REVERSIBLE EFFECT OF BRINGING THE BREASTS CLOSER TOGETHER

(71) Applicant: HANES OPERATIONS EUROPE SAS, Rueil Malmaison (FR)

(72) Inventor: Manon Turlan-Van Der Hoeven, Marmagne (FR)

(73) Assignee: Hanes Operations Europe SAS, Rueil-Malmaison (FR)

( * ) Notice: Subject to any disclaimer, the term of this patent is extended or adjusted under 35 U.S.C. 154(b) by 152 days.

(21) Appl. No.: 14/906,226

(22) PCT Filed: Jul. 21, 2014

(86) PCT No.: PCT/FR2014/051867
§ 371 (c)(1),
(2) Date: Jan. 19, 2016

(87) PCT Pub. No.: WO2015/008005
PCT Pub. Date: Jan. 22, 2015

(65) Prior Publication Data

US 2016/0157528 A1 Jun. 9, 2016

(30) Foreign Application Priority Data

Jul. 19, 2013 (FR) ..... 13 57126

(51) Int. Cl.
*A41C 3/00* (2006.01)

(52) U.S. Cl.
CPC ..... *A41C 3/0028* (2013.01); *A41C 3/0007* (2013.01)

(58) Field of Classification Search
CPC ..... A41C 3/00; A41C 3/02; A41C 3/0028; A41C 3/0007; A41F 1/00; A41F 1/006; A41F 1/002; A44B 17/0029
(Continued)

(56) References Cited

U.S. PATENT DOCUMENTS 2,668,954 A * 2/1954 Frohlich ..... A41F 1/00 2/323
3,376,616 A 4/1968 Kaczorowski
(Continued)

FOREIGN PATENT DOCUMENTS

CN 2312306 Y 3/1999
CN 201267189 Y 7/2009
(Continued)

OTHER PUBLICATIONS

Australian Government IP Australia, Patent Examination Report No. 1, Application No. 2014291909, dated Jun. 20, 2016, 2 pages.
(Continued)

*Primary Examiner* — Gloria Hale
(74) *Attorney, Agent, or Firm* — Fish & Richardson P.C.

(57) ABSTRACT

A bra with a reversible effect of bringing the breasts closer together includes two cups linked together by a bridge portion and an adjustment device for adjusting the distance between the cups located at the bridge portion. The adjustment device includes a first fastening element and a second fastening element arranged on either side of the bridge portion and movable relative to each other between a coupled position in which the two cups are brought closer together and an uncoupled position in which the two cups are moved apart.

26 Claims, 1 Drawing Sheet

(58) Field of Classification Search
USPC ..... 450/58, 71, 63, 76, 77, 79, 80, 91, 17, 450/23, 28, 33; 2/69, 102, 114, 115, 113, 2/96
See application file for complete search history.

(56) References Cited

U.S. PATENT DOCUMENTS

| | | | | |
|---|---|---|---|---|
| 6,123,601 | A * | 9/2000 | Hildebrandt | A41F 1/006 24/306 |
| 6,260,242 | B1 * | 7/2001 | Fildan | A44B 17/0029 24/329 |
| 6,260,243 | B1 * | 7/2001 | Fildan | A44B 17/0029 24/114.4 |
| 6,406,354 | B1 * | 6/2002 | Yamauchi | A41C 3/02 450/58 |
| 7,232,359 | B1 * | 6/2007 | Richardson | A41C 3/0028 450/1 |
| 7,407,430 | B1 * | 8/2008 | Wanzenbock | A41C 3/02 2/67 |
| 8,408,964 | B1 * | 4/2013 | Acker | A41F 1/006 2/336 |
| 9,049,894 | B2 * | 6/2015 | Wong | A41F 1/002 |
| 2003/0013379 | A1 * | 1/2003 | Henz | A41C 3/00 450/1 |
| 2011/0201253 | A1 | 8/2011 | Stude | |
| 2013/0109276 | A1 | 5/2013 | Sporn | |
| 2014/0357159 | A1 * | 12/2014 | Balland | A41C 3/0028 450/80 |
| 2016/0157528 | A1 * | 6/2016 | Hoeven | A41C 3/0028 450/52 |

FOREIGN PATENT DOCUMENTS

| | | | |
|---|---|---|---|
| CN | 102204725 | | 10/2011 |
| GB | 2496926 | A | 5/2013 |
| JP | H10-0234428 | | 9/1998 |
| JP | 2002212805 | A | 7/2002 |
| JP | 2008504074 | | 2/2008 |
| JP | 3145793 | | 10/2008 |
| KR | 20-0346501 | Y1 | 4/2004 |
| KR | 10-2013-0020145 | A | 2/2013 |
| WO | WO2006002428 | | 1/2006 |

OTHER PUBLICATIONS

Korean Intellectual Property Office, Notification of Reason for Refusal, Application No. 10-2016-7004058, dated Apr. 14, 2017, 7 pages.
PCT International Search Report and Written Opinion of the International Searching Authority, PCT/FR2014/051867, dated Nov. 14, 2014, 8 pages.

* cited by examiner

BRA WITH A REVERSIBLE EFFECT OF BRINGING THE BREASTS CLOSER TOGETHER

TECHNICAL FIELD

In general, the disclosure concerns bras and more specifically, the disclosure concerns a bra comprising two cups linked together through their inside by a bridge portion and comprising means for adjusting the distance between the cups located at the bridge portion and capable of reducing or extending selectively the distance between the cups, with said adjustment means comprising reversible means for fastening the two cups together.

BACKGROUND

Such a bra is well-known by the person skilled in the art, such as by the example provided in the CN201409464 patent document. Indeed, this patent document reveals a system that adjusts the distance between the cups of a bra, that permits bringing closer or moving apart the breasts of the bra wearer. To do so, one of the cups is provided with an extension portion at the bridge provided at its end with a button that fits into button holes provided at regular intervals along the bottom periphery of the other cup, so as to adjust the distance between the cups according to the position of the button. However, the adjustment of the distance between the cups remains restrictive because it requires at least partial undressing and difficult handling.

Other solutions are also known that enable expanding the shape of the chest by an effect that brings breast closer together ("cleavage") created by systems located at the bridge portion. As such, systems are known that allow for adjusting the distance between the breasts by acting on the length of a pull cord that brings the two cups together through a locking mechanism comprising a push-button by which, during activation, the lock on the pull cord is released so that the pull cord can slide freely through the locking mechanism, which makes it possible for instance by pulling downward on the cord to bring the two cups closer together and thus decrease the gap between the breasts. If this solution permits action on the distance between the cups so as to generate a "cleavage" effect that is selectively adjustable, it is nevertheless not totally satisfactory since this effect cannot be achieved discreetly or instantaneously.

Also known are bras for which the two cups are linked by a lace through a series of eyelets provided along the respective edges of the insides of the two cups, for which the degree of tightening enables obtaining a more or less pronounced "cleavage" effect. Here also, this mechanism permits achieving a "cleavage" effect that is certainly effective but which requires the user to isolate herself to make the adjustment.

Finally, there are systems that permit bringing the breasts closer together based on the addition of removable foam rubber pads in the bra cups. On the other hand, even though the pads are removable, here the reversibility of the "cleavage" effect remains very laborious since it involves as a first step removing the bra, and, then removing the pads inserted inside the cups.

SUMMARY

In this context, the purpose of this disclosure is to propose a bra without at least one of the limitations previously mentioned. In particular, the purpose of this disclosure is to propose a bra that permits acting simply and quickly on bringing breasts closer together ("cleavage") reversibly, while doing so discreetly.

For that purpose, the bra of the disclosure, which is in fact in accordance with the generic definition given by the above preamble, is essentially characterized in that said reversible fastening means comprise a first fastening means and a second fastening means provided on both sides of the bridge portion and movable one with respect to the other between a linking position in which the two cups are brought closer together and an uncoupling position where the two cups are spread, as a result of a pressure applied manually on the side of the cups opposite the bridge portion, essentially in the direction of the bridge portion.

Thanks to this arrangement, the reversible fastening means that permit adjusting the distance between the cups can be handled easily and quickly by a simple tightening of the arms or a simple holding the hands on the sides of the breasts, so that a single movement suffices to accomplish coupling the fastening means required to generate the "cleavage" effect, while the same movement also permits uncoupling fastening elements to return to the prior position of the bra.

In the preferred method of embodiment of the disclosure, the bra includes a guiding device for moving at least one of the fastening means, with the guiding means delimiting a guiding path between the fastenings means in which at least one of the fastening means is introduced during the movement of the two fastening means towards their coupling position.

This structure beneficially permits the assurance of a guided coupling of the fastening elements between themselves.

For example, the guiding device may include a positive guiding slope that progresses between the two fastening means, thus defining the guiding path required to ensure the guided coupling of the two fastening means.

The bra preferably comprises securing means of at least one of said fastening means on the guiding path when the two fastening means are moving towards their coupling position. The securing means beneficially permit the forced move of the guided fastening means towards and along the guiding path defined by the guiding device and thus toward the other fastening element so that the guided fastening element is sure to engage with the other fastening element to which it is to be coupled when initiating the "cleavage" effect by applying lateral pressure.

Said securing means may include a magnet mounted integrally in said guidance device and arranged opposite at least one of said fastening elements with respect to the guidance path.

According to a method of embodiment, the fastening elements comprise a guided hook and a guiding eyelet, with the guiding device being assembled with the guiding eyelet, with the guiding path receiving the guided hook.

The fastening elements may be arranged on the internal or external face of the cups.

In a variant, the fastening elements may be arranged between the cups at the rigid wires inserted in the bra at the bottom periphery of the cups.

Preferably, the bridge portion comprises an extension limiting device arranged between the cups that is adjusted to work with the means for adjusting the distance between the cups, so as to limit the maximum gap between the cups in the uncoupling position of the fastening elements.

According to a preferred method of embodiment, the extension limiting device arranged between the cups comprises at least one elastic textile piece, for which the elasticity limit permits defining the maximum gap between the cups.

BRIEF DESCRIPTION OF THE DRAWINGS

Other features and advantages of the disclosure will surface upon reading the description below of a specific method of embodiment of the disclosure, given for information but not for limiting purposes, with reference to the attached drawings where.

DETAILED DESCRIPTION

Figure 1:
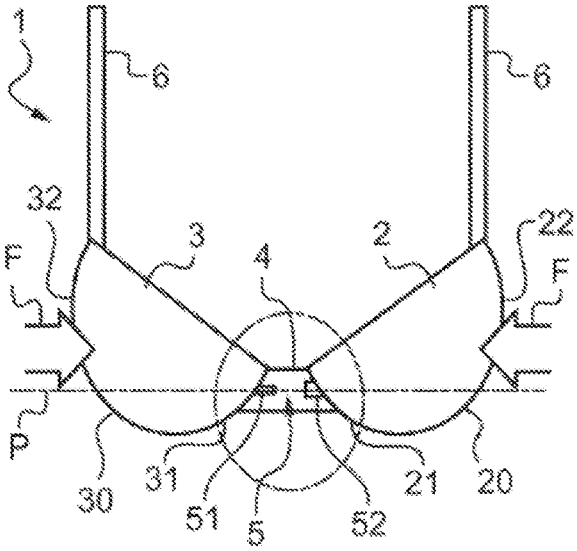
FIG. 1 is a schematic front view of a bra as per the disclosure showing the two cups in a separated position.

Bra 1 of the disclosure includes two cups, respectively a left cup 2 and a right cup 3, showing a classic concave shape on the side of their internal face turned towards the skin (substantially and partially hemispheric). Cups 2 and 3 are generally linked together on their inner side 21, 31 by a short bridge portion 4 substantially in the extension of the bottom periphery 20, 30 of each cup 2, 3. As per the disclosure, the bridge portion is arranged to receive means 5 for adjusting the distance between the cups for generating an effect that brings the breasts closer together, as will be seen in greater detail below. The bottom periphery 20, 30 of each cup 2, 3 pulls up laterally so that a lateral portion 22, 32 on the outside of cups 2, 3 opposite the bridge portion 4 with respect to the cups is linked to arms not shown forming flat parts on the back of bra 1, which end in fasteners that permit closing the back of the bra. In addition, straps 6 tie the top of cups 2, 4 on the outside, to the flat parts on the back.

Figure 2:
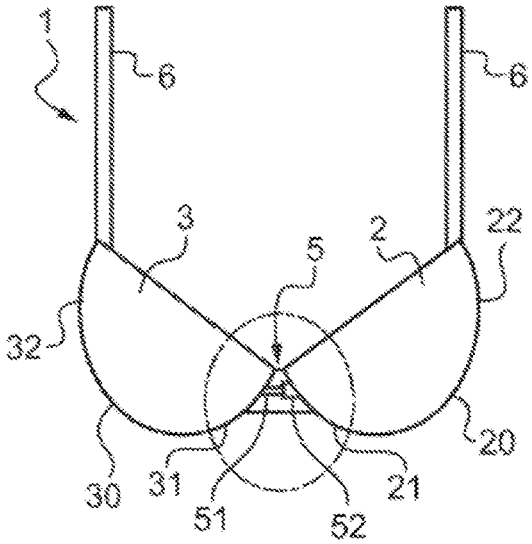
FIG. 2 is a schematic front view of a bra as per the disclosure showing the two cups brought closer together.

The means 5 for adjusting the distance between the cups include reversible fastening means, shown schematically on FIGS. 1 and 2 that include a first fastening element 51 and a second fastening element 52, located on both sides of the bridge portion 4, and consisting for instance of a hook 51 located on one of the cups, for instance the right cup 3 and of an eyelet 52 located on the other left cup 2, opposite the hook 51.

Hook 51 and eyelet 52 are intended to be coupled reversibly, so that in their coupling position they bring the two cups 2 and 3 closer together to generate a "cleavage" effect. As per the disclosure, hook 51 and eyelet 52 can be moved one with respect to the other from their uncoupling position (see FIG. 1) towards their coupling position (see FIG. 2) and inversely, as a result of a lateral pressure F applied manually at the side portion 22, 32 of cups 2, 3 essentially in the direction of the bridge portion 4 on either side of which are arranged hook 51 and eyelet 52. As a result, the "cleavage" effect is made adjustable by a simple tightening of the arms by the person wearing the bra, or else, by simply pressing the user's hands on the side of the breasts, in order to produce said lateral pressure F on cups 2, 3 of the bra.

More specifically, as schematically illustrated in FIGS. 1 and 2, hook 51 and eyelet 52 may be located between the cups at the rigid reinforcement wires that may be inserted in an edge at the bottom periphery 20, 30 of cups 2, 3. Such an arrangement will permit generating a satisfactory though light "cleavage" effect, to the extent that the bringing together of the wires will then be limited by the space occupied by the fastening elements in their coupling position.

As a variant, hook 51 and eyelet 52 can be located on the internal or external face of cups 2, 3, at a certain distance from their periphery. As such, in their coupling position they will permit generation of a more pronounced "cleavage" effect by the fact that the distance between the cups can then be reduced as much as possible.

Figure 3:
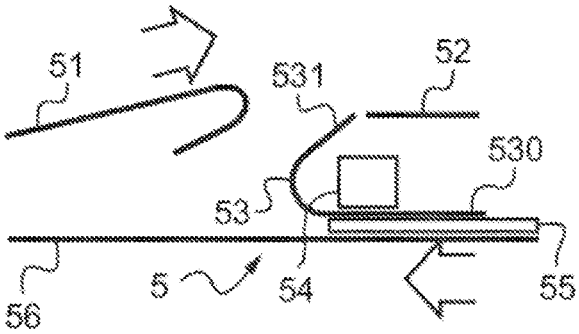
FIGS. 3 to 5 are detailed schematic sectional views as per plane P of the means for adjusting the distance between the cups according to a preferred method of embodiment of the disclosure, respectively in a position of uncoupling of the fastening elements, in a position of moving the fastening elements towards each other, towards their fastening position and in the coupling position of the fastening elements.

Whatever the arrangement of fastening elements 51, 52 of the hook/eyelet type of means 5 for adjusting the distance between the cups, their arrangement will now be described in greater detail, with reference to FIGS. 3 to 5 that show means 5 for adjusting the distance between the cups as a sectional view according to plane P of FIG. 1, as per a first method of embodiment.

Consequently, means 5 for adjusting the distance between cups preferably includes a guiding device 53 for moving hook 51, capable of guiding the latter towards eyelet 52, following the lateral pressure F leading to the movement of hook 51 and eyelet 52 towards their coupling position. Guiding device 53 represents at the same time a support for eyelet 52 with which it is to be assembled. To do so, it includes a plate forming support 530 having an inclined flank 531 with a positive slope in the direction of movement of hook 51 towards its coupling position with eyelet 52 and for which the free end is extended by eyelet 52, which is secured to it by one of its edges, so that eyelet 52 and the plate forming support 530 are preferably located in substantially parallel planes. Mention will be made subsequently of guided hook 51 and guiding eyelet 52.

Figure 4:
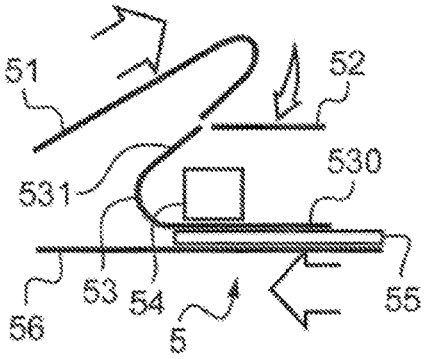
Figure 5:
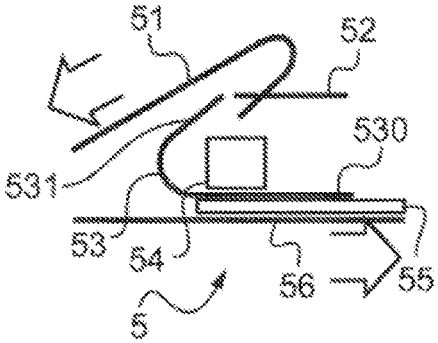

By forming a positive slope progressing between guided hook 51 and guiding eyelet 52, inclined flank 531 of guiding device 53 consequently delimits a guiding path between guided hook 51 and guiding eyelet 52, capable of receiving guided hook 51 to operate the translation of the latter according to the direction of the slope towards guiding eyelet 52 for coupling, as illustrated in FIGS. 4 and 5.

In addition, a guiding magnet 54 may beneficially be arranged opposite guided hook 51 with respect to inclined flank 531 that forms the guiding path of guiding device 53, so as to be in a position to attract guided hook 51, beneficially metal in nature, and consequently to secure it towards and along guiding path 531 when the lateral pressure F is applied to bring about the coupling between guided hook 51 and guiding eyelet 52. Magnet 54 is preferably incorporated in guiding device 53 and according to the example shown in FIGS. 3 to 5, magnet 54 is located on a higher surface of the plate forming support 530, substantially at the foot of inclined flank 531 of guiding device 53.

Figure 6:
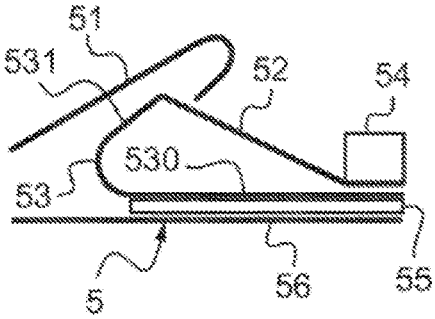
FIG. 6 is a schematic sectional view as per plane P showing a variant of embodiment of the means for adjusting the distance between the cups.

According to another method of embodiment shown in FIG. 6, eyelet 52 is inclined towards plate forming support 530 and guiding magnet 54 is offset on the edge of eyelet 52 opposite the one mounted on the free end of guiding path 531.

Magnet 54 used must preferably produce a magnetic field that does not exceed the sensitivity threshold of the cardiac stimulation devices that may be carried by a user, typically 1 mT, so that the bra as per the disclosure may be used safely under these specific circumstances.

Consequently, guiding device 53, in combination with the guiding magnet 54 action, enables guided hook 51 to couple inevitably with guiding eyelet 52 when guided hook 51 and guided eyelet 52 are induced to move towards their coupling position under the effect of the lateral pressure F. In this case, guiding device 53 will beneficially be made of a plastic material so as not to generate any interference between magnet 54 and guided hook 51, which may reduce the effectiveness of fastening.

A magnetic insulating strip 55 may be beneficially used to cover the bottom surface of the plate forming support 530 of guiding device 53, under magnet 54, so as to prevent any attraction of guided hook 51 by the magnet in a direction other than the one leading to guiding eyelet 52 via guiding path 531.

Beneficially, bridge portion 4 is provided with an extension limiting device designed to work together with means 5 for adjusting the distance between the cups, so as to limit the maximum gap between cups 2,3 in the uncoupling position of guided hook 51 and guiding eyelet 52.

Consequently, the extension limiting device can include a textile part 56 in the form of strip that is preferably plastic, positioned between the cups to which it is secured by its ends and preferably located frontally with respect to means 5 for adjusting the distance between the cups, thus masking the latter. The elastic fabric strip is designed to work with means 5 for adjusting the distance between the cups so as to limit the maximum gap between the cups in the uncoupling position of guided hook 51 and guiding eyelet 52, with maximum stretching of the fabric when these fastening elements are uncoupled, thus defining the gap limit between cups 2, 3. One shall beneficially select an elastic warp and weft fabric with limited stretch, preferably in the range of 50 to 250% and relatively "nervous". In addition, elasticity shall be unilateral so that the fabric does not roll back upon onto itself when stretched.

The extension limiting device can also be designed to form a sheath, preferably in elastic fabric that extends between the cups and surrounds means 5 for adjusting the distance between the cups, which are consequently inserted in this sheath. The latter shall not only permit hiding means 5 for adjusting in full the distance between the cups, but also permit forming a protective cover for the user against possible irritation and/or rubbing. In addition, the sheath also plays a role of extension limiter in order to limit or control the maximum gap between the cups in the uncoupling position of fastening elements 51, 52. For that purpose, the sheath is made of an elastic fabric having the same features as those mentioned above, namely, a warp and weft fabric with limited stretching, preferably in the range of 50 to 250% and relatively "nervous". Elasticity shall in addition be unilateral so that the fabric does not roll back onto itself when stretched. Consequently, the maximum gap of the cups will be limited by the maximum stretching ability of the fabric forming the sheath when fastening elements 51, 52 are uncoupled.

The invention claimed is:

1. A bra comprising:

two cups linked together on inner sides of the two cups by a bridge portion and comprising means for adjusting a distance between the two cups located at the bridge portion and selectively reducing or extending the distance between the two cups, with said adjustment means comprising reversible fastening means for fastening the two cups together, wherein said reversible fastening means include a first fastening element and a second fastening element arranged on either side of the bridge portion, the first fastening element and the second fastening element being movable with respect to each other between a coupling position in which the two cups are brought closer together and an uncoupling position in which the two cups are moved apart, as a result of a pressure (F) on a side portion of the two cups opposite the bridge portion in a direction of the bridge portion; and a guiding device comprising a plate for moving at least one of the first fastening element or the second fastening element when applying said pressure (F), where the guiding device delimits a guiding path between the first fastening element and the second fastening element in which at least one of the first fastening element or the second fastening element is engaged during a movement of the first fastening element and the second fastening element toward the coupling position.

2. The bra according to claim 1, wherein the guiding device includes a positive guiding slope progressing between the first fastening element and the second fastening element that define the guiding path required to ensure a guided coupling of the two fastening elements.

3. The bra according to claim 1, comprising a securing means to secure at least one of the first fastening element or the second fastening element on the guiding path during the movement of the first fastening element and second fastening element toward the coupling position.

4. The bra according to claim 3, wherein said securing means include a magnet located opposite at least one of the first fastening element or the second fastening element with respect to the guiding path.

5. The bra according to claim 1, wherein the first fastening element includes a guided hook and the second fastening element includes a guiding eyelet, the guiding device being assembled with the guiding eyelet, with the guiding path receiving the guided hook.

6. The bra according to claim 1, wherein the first fastening element and the second fastening element are arranged on an internal or external face of the two cups.

7. The bra according to claim 1, wherein the first fastening element and the second fastening element are arranged between the cups at rigid wires inserted in the bra at a bottom periphery of the cups.

8. The bra according to claim 1, wherein the bridge portion includes an extension limiting device arranged between the two cups, the extension limiting device and the means for adjusting the distance between the cups adapted to limit a maximum gap between the two cups in the uncoupling position of the first fastening element and the second fastening element.

9. The bra according to claim 8, wherein the extension limiting device includes at least an elastic textile piece for which the elasticity limit permits defining the maximum gap between of the cups.

10. A bra comprising:

two cups linked together on inner sides of the two cups by a bridge portion and comprising an adjustment device configured to adjust a distance between the two cups located at the bridge portion and selectively reduce or extend the distance between the cups, the adjustment device comprising a first fastening element and a second fastening element arranged on either side of the bridge portion and configured to fasten the two cups together, wherein the first fastening element and the second fastening element are movable with respect to each other between a coupling position in which the two cups are brought closer together and an uncoupling position in which the two cups are moved apart, as a result of a pressure (F) on a side portion of the two cups opposite the bridge portion in a direction of the bridge portion; and a guiding device comprising a plate for moving at least one of the first fastening element or the second fastening element when applying said pressure (F), where the guiding device delimits a guiding path between the first fastening element and the second fastening element in which at least one of the first fastening element or the second fastening element is engaged during a movement of the first fastening element and the second fastening element towards the coupling position.

11. The bra according to claim 10, wherein the guiding device includes a positive guiding slope progressing between the first fastening element and the second fastening element that define the guiding path required to ensure a guided coupling of the first fastening element and the second fastening element.

12. The bra according to claim 10, comprising a securing device configured to secure at least one of the first fastening element or the second fastening element on the guiding path during the movement of the first fastening element and the second fastening element toward the coupling position.

13. The bra according to claim 12, wherein said securing device includes a magnet located opposite at least one of the first fastening element or the second fastening element with respect to the guiding path.

14. The bra according to claim 13, wherein the first fastening element includes a guided hook and the second fastening element comprises a guiding eyelet, where the guiding device is assembled with the guiding eyelet, and the guiding path configured to receive the guided hook.

15. The bra according to claim 14, wherein the bridge portion includes an extension limiting device arranged between the cups, the extension limiting device and the adjustment device adapted to limit a maximum gap between the two cups in the uncoupling position of the first fastening element and the second fastening element.

16. The bra according to claim 15, wherein the extension limiting device includes at least an elastic textile piece for which the elasticity limit permits defining the maximum gap between of the cups.

17. The bra according to claim 10, wherein the first fastening element includes a guided hook, and the second fastening element comprises a guiding eyelet.

18. The bra according to claim 10, wherein the first fastening element includes a guided hook and the second fastening element comprises a guiding eyelet, where the guiding device is assembled with the guiding eyelet, and the guiding path configured to receive the guided hook.

19. The bra according to claim 10, wherein the first fastening element and the second fastening element are arranged on an internal or external face of the cups.

20. The bra according to claim 10, wherein the first fastening element and the second fastening element are arranged between the cups at rigid wires inserted in the bra at a bottom periphery of the cups.

21. The bra according to claim 10, wherein the bridge portion includes an extension limiting device arranged between the cups, the extension limiting device and the adjustment device adapted to limit a maximum gap between the two cups in the uncoupling position of the first fastening element and the second fastening element.

22. The bra according to claim 21, wherein the extension limiting device includes at least an elastic textile piece for which the elasticity limit permits defining the maximum gap between of the cups.

23. The bra according to claim 21, wherein the extension limiting device forms a sheath of elastic fabric that extends between the cups and surrounds the adjustment device.

24. The bra according to claim 10, comprising a plate forming support for the guiding device having a guiding surface with a positive slope.

25. The bra according to claim 24, wherein the first fastening element is an eyelet, and the plate and the eyelet are located in substantially parallel planes.

26. The bra according to claim 24, wherein the first fastening element is an eyelet, and the eyelet is inclined toward the plate.

* * * * *